US009757962B2

(12) United States Patent
Katayama et al.

(10) Patent No.: US 9,757,962 B2
(45) Date of Patent: Sep. 12, 2017

(54) PRINTER

(71) Applicant: SATO HOLDINGS KABUSHIKI KAISHA, Tokyo (JP)

(72) Inventors: Tamotsu Katayama, Saitama (JP); Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/304,186

(22) PCT Filed: Apr. 8, 2015

(86) PCT No.: PCT/JP2015/060947
§ 371 (c)(1),
(2) Date: Oct. 14, 2016

(87) PCT Pub. No.: WO2015/170543
PCT Pub. Date: Nov. 12, 2015

(65) Prior Publication Data

US 2017/0036462 A1 Feb. 9, 2017

(30) Foreign Application Priority Data

May 8, 2014 (JP) ..... 2014-096924

(51) Int. Cl.
*B41J 29/13* (2006.01)
*B41J 11/00* (2006.01)
(Continued)

(52) U.S. Cl.
CPC ..... *B41J 11/0045* (2013.01); *B41J 3/36* (2013.01); *B41J 3/4075* (2013.01); *B41J 15/04* (2013.01); *B41J 29/13* (2013.01); *B65C 9/18* (2013.01)

(58) Field of Classification Search
CPC . B41J 2/32; B41J 3/4075; B41J 15/042; B41J 2/325; B41J 11/42; B41J 11/04;
(Continued)

(56) References Cited

U.S. PATENT DOCUMENTS 6,530,705 B1 3/2003 Petteruti et al.
7,891,893 B2 * 2/2011 Sekino ..... B41J 2/32 347/218
(Continued)

FOREIGN PATENT DOCUMENTS

JP 2006-150858 A 6/2006
JP 2007-185774 A 7/2007

*Primary Examiner* — Lamson Nguyen
(74) *Attorney, Agent, or Firm* — Foley & Lardner LLP

(57) ABSTRACT

A printer has a separation unit attached to a support board. The separation unit includes a guide rail hole to engage with a shaft so as to slide and swing with respect to the support board. The separation unit moves to a continuous ejection position in which one end of the guide rail hole comes in contact with the shaft, swings in a first rotation direction about the shaft in contact with the other end side of the guide rail hole so as to move away from a thermal head to a swing end position in which the separation unit on the forward end side is within a swing trajectory of the opening and closing cover, and swings from the swing end position in a second rotation direction while engaging on the forward end side with the opening and closing cover moving to the closed position so as to be located at a separation ejection position where the separation roller is adjacent to the feed roller when the opening and closing cover is located at the closed position.

20 Claims, 17 Drawing Sheets

(51) Int. Cl.

| | |
|---|---|
| ***B41J 3/36*** | (2006.01) |
| ***B41J 15/04*** | (2006.01) |
| ***B65C 9/18*** | (2006.01) |
| ***B41J 3/407*** | (2006.01) |

(58) Field of Classification Search
CPC ..... B41J 15/046; B41J 11/425; B41J 15/02; B41J 15/18; B41J 17/02; B41J 17/32
See application file for complete search history.

(56) References Cited

U.S. PATENT DOCUMENTS

| | | | | |
|---|---|---|---|---|
| 8,907,997 | B1 * | 12/2014 | Takahashi | B41J 11/0025 347/218 |
| 8,994,767 | B1 * | 3/2015 | Liao | B41J 11/70 347/218 |
| 2006/0151118 | A1 | 7/2006 | Murata et al. | |

* cited by examiner

PRINTER

TECHNICAL FIELD

The present invention relates to a printer, e.g., a label printer configured to print desired information, such as letters, symbols, graphics, barcodes, or the like on a label temporarily adhering to a mount and having a separation ejection function to separate the label from the mount and eject the same.

BACKGROUND ART

Label printers include a thermal head and a platen roller. The label printers pinch one end in the longitudinal direction of a label continuous body wound into a roll between the thermal head and the platen roller, reel off the label continuous body, and rotate the platen roller to feed the label continuous body in a sheet shape, for example. During this feeding, the thermal head in this label printer prints desired information on each of a plurality of labels temporarily adhering to a long strip of mount included in the label continuous body.

There are two types of ejection schemes for such label printers, including continuous ejection and separation ejection. The continuous ejection is to eject labels while leaving the labels temporarily adhering to a mount. The separation ejection is to separate labels from a mount and then eject the same.

In the case of the continuous ejection, the operator cuts off a mount having a required number of labels attached thereon from a label continuous body. Then the operator can bring this cut-off mount to the site, and can separate the labels from the mount for attachment at the site. The continuous ejection is therefore suitable for the case where a target for attachment of the labels is located in a place away from the printer.

Meanwhile in the case of the separation ejection, the printer ejects labels separated from a mount one by one. The separation ejection is therefore suitable for the case where a target for attachment of the labels is located near the operator. For the separation ejection, a separation unit attached to the printer is set at the separation ejection position. Then one end in the longitudinal direction of the mount is bent via a separation pin, and the one end is pinched between a separation roller of the separation unit and a platen roller. Thereby, when the label continuous body is fed for printing by rotating the platen roller, the mount is fed while being pinched between the separation roller and the platen roller. During the feeding, the printed labels are separated from the mount one by one and are ejected from the printer.

For a printer having the two types of ejection modes including the continuous ejection and the separation ejection, the printer described in Laid open patent publication JP 2006-150858 A is known, for example.

SUMMARY OF THE INVENTION

Technical Problem

Such printers having the two types of ejection modes of continuous ejection and separation ejection are required to easily switch the separation unit from the continuous ejection position to the separation ejection position.

In view of the technical background as described above, the present invention aims to provide a printer capable of easily switching the separation unit from a continuous ejection position to a separation ejection position.

Solution to Problem

A printer according to a first aspect of the present invention is configured to print on a print medium including a label temporarily adhering to a mount, and the printer comprises: a housing; an opening and closing cover pivotally supported at the housing and configured to swing; a feed roller located rotatable at the opening and closing cover, the feed roller configured to feed the print medium; a print head located so as to be adjacent to the feed roller at a closed position of the opening and closing cover, the print head configured to print on the print medium; a support board including a swing shaft; and a separation unit attached to the support board so as to be swingable about the swing shaft, the separation unit including a separation roller that is rotatably located on the separation unit on a forward end side thereof that is one end side adjacent to the opening and closing cover, the separation unit being located at a separation ejection position where the separation roller is adjacent to the feed roller and being located at a continuous ejection position where the separation roller is stored inside of the housing so as not to be adjacent to the feed roller.

A printer according to a second aspect of the present invention may further comprise a container to contain the print medium, wherein the separation unit swings in a first rotation direction in which the separation roller moving away from the print head to a swing end position, the separation unit on the forward end side engages with the opening and closing cover moving to the closed position to close the container, and the separation unit swings in a second rotation direction opposite to the first rotation direction to the separation ejection position where the separation roller is adjacent to the feed roller.

A printer according to a third aspect of the present invention is configured to print on a print medium including a label temporarily adhering to a mount, and the printer comprises: a housing; a container configured to contain the print medium; an opening and closing cover pivotally supported at the housing and configured to swing to open and close the container; a feed roller rotatably located on the opening and closing cover, the feed roller configured to feed the print medium; a print head located so as to be adjacent to the feed roller at a closed position of the opening and closing cover, the print head configured to print on the print medium; a support board including a swing shaft; and a separation unit including a pair of supporters each having a long hole and attached to the support board, each long hole engaging with the swing shaft so that the separation unit is slidable along the swing shaft and swingable about the swing shaft, the separation unit including a separation roller that is rotatably located on the separation unit on a forward end side thereof that is one end side adjacent to the opening and closing cover, the separation unit being located at a continuous ejection position where the swing shaft is located on one side of each long hole and the separation roller is not adjacent to the feed roller, the separation unit sliding from the continuous ejection position along the swing shaft until the swing shaft is located on the other side of each long hole, and then swinging in a first rotation direction about the swing shaft, the separation roller moving away from the print head in the first rotation direction, the separation unit being located at a swing end position where a first claw of the separation unit comes in contact with a first stopper of the support board and the separation unit on the forward end side is present within a swing trajectory of the opening and closing cover, the separation unit swinging from the swing end position in a second rotation direction opposite to the first rotation direction about the swing shaft located on the other side of each long hole while engaging on the forward end side thereof with the opening and closing cover moving from an opening position where the container is open to the closed position where the container is closed, and the separation unit being located at a separation ejection position where the separation roller is adjacent to the feed roller so as to follow the closing of the opening and closing cover.

A printer according to a fourth aspect of the present invention may further comprise a coil spring located between the separation unit and the support board, wherein the coil spring is configured to apply a first biasing force to the separation unit in a direction that brings the swing shaft toward the other side of each long hole, the first biasing force causes the separation unit to swing in the first rotation direction about the swing shaft located on the other side of each long hole, the coil spring is configured to apply a second biasing force, and the second biasing force causes the separation unit to swing in the first rotation direction about the swing shaft that is located at the other side of each long hole due to the first biasing force.

In a printer according to a fifth aspect of the present invention, the support board may have a guide surface configured to guide a movement direction of the separation unit sliding from the continuous ejection position along the swing shaft, and the first claw slide on the guide surface.

In a printer according to a sixth aspect of the present invention, the separation unit may have a second claw configured to come in contact with a second stopper located at the support board at the separation ejection position so as to regulate the separation unit to return to the continuous ejection position.

In a printer according to a seventh aspect of the present invention, the support board may have a regulation surface, the first claw slides on the regulation surface when the separation unit swings from the swing end position in the second rotation to move to the separation ejection position so as to regulate the separation unit to return to the continuous ejection position.

Advantageous Effects

According to the present invention, the separation unit can be easily switched from the continuous ejection position to the separation ejection position.

DESCRIPTION OF EMBODIMENTS

Figure 1A:
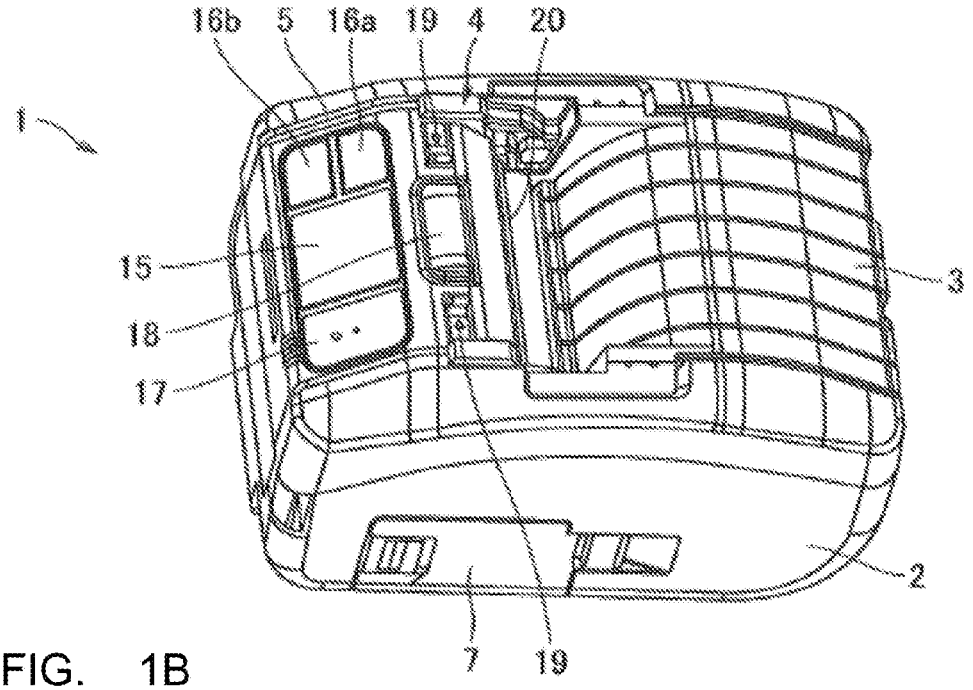
FIG. 1A is an overall perspective view of a printer according to the present embodiment in the continuous ejection state.

The present invention relates to Japanese Patent Application No. 2014-096924, filed on May 8, 2014, the contents of which are incorporated herein by reference.

The following describes one embodiment of the present invention as one example in details, with reference to the drawings. In the drawings to describe the embodiment, the same reference numerals are basically assigned to the corresponding elements, and the repeated descriptions thereon are omitted.

Figure 1B:
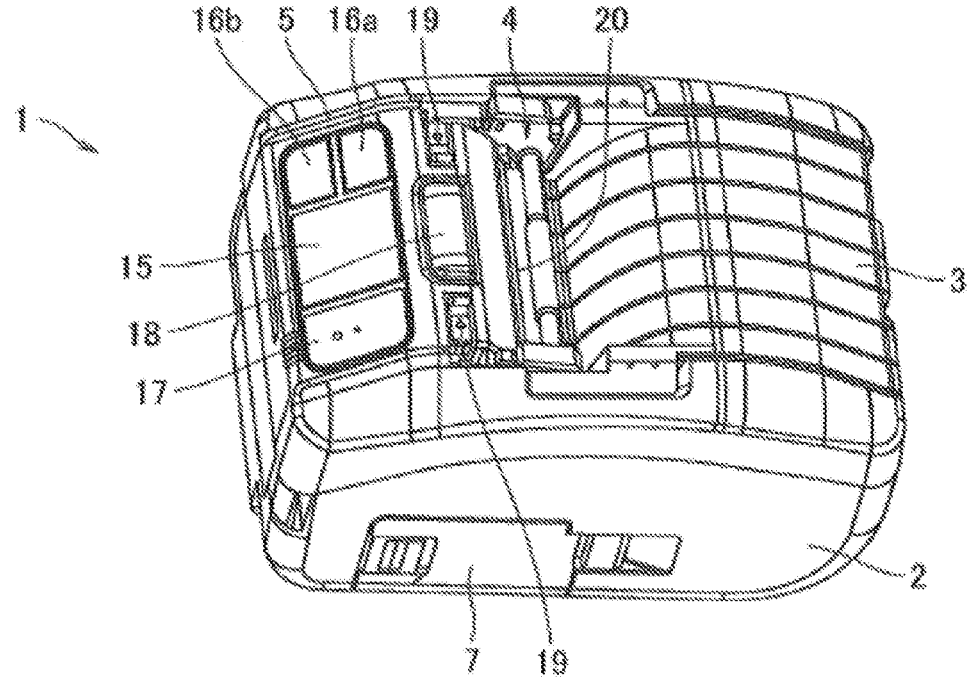
FIG. 1B is an overall perspective view of a printer according to the present embodiment in the separation ejection state.
Figure 2:
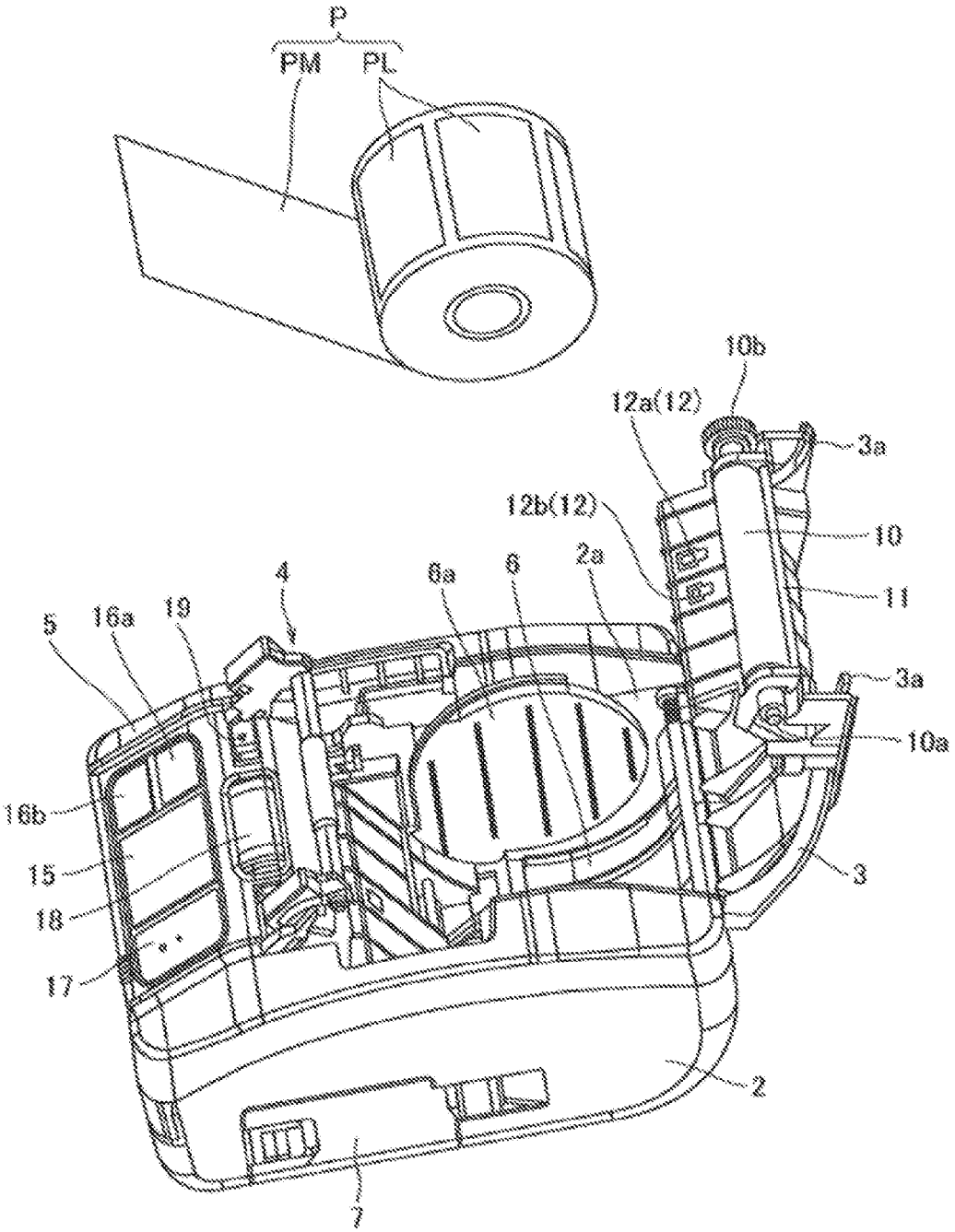
FIG. 2 is an overall perspective view showing the appearance of the printer of FIGS. 1A and 1B when the opening and closing cover is open, and the label continuous body.
Figure 3:
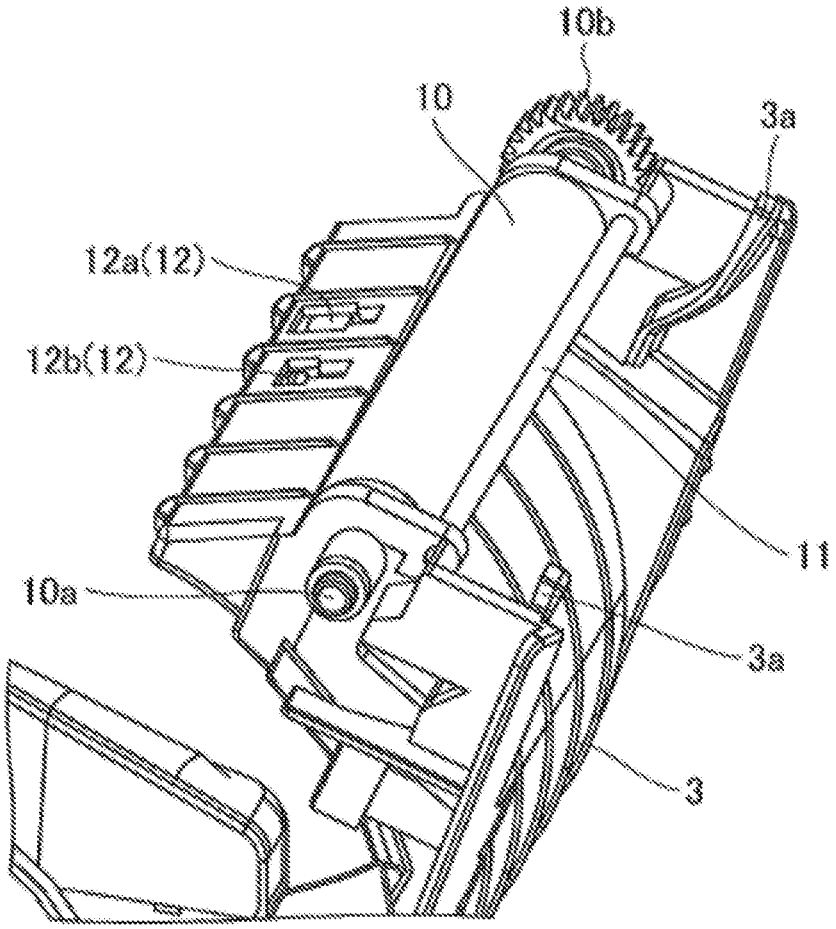
FIG. 3 is a perspective view showing the major part of the opening and closing cover of the printer of FIGS. 1A and 1B.

FIG. 1A is an overall perspective view of a printer according to the present embodiment in the continuous ejection state. FIG. 1B is an overall perspective view of a printer according to the present embodiment in the separation ejection state. FIG. 2 is an overall perspective view showing the appearance of the printer of FIGS. 1A and 1B when the opening and closing cover is open, and the label continuous body. FIG. 3 is a perspective view showing the major part of the opening and closing cover of the printer of FIGS. 1A and 1B.

As shown in FIGS. 1A and 1B, the printer 1 of the present embodiment is a portable label printer that has a flat cuboid shape, for example. This printer 1 includes a body case (one example of a housing) 2, an opening and closing cover 3, a separation unit 4, and a front cover 5. The printer 1 can be switched between a continuous ejection mode and a separation ejection mode, i.e., is configured as a double-function type. The printer 1 can be used with its outlet directed upward (transverse posture). The printer 1 can be used with a belt hook (not illustrated) on the bottom of the printer 1 hanging from a belt of the operator, or can be used with a shoulder belt (not illustrated) hanged on the shoulder of the operator so as to place the outlet laterally (placing it vertically).

The body case 2 is a housing that defines a part of the outer shape of the printer 1. On one face of the body case 2, an opening 2*a* is formed as shown in FIG. 2. In this opening 2*a*, a paper container (one example of a container) 6 is located. The paper container 6 is a region in which a roll-shaped label continuous body (one example of a print medium) P is contained. Inside of the paper container 6, a sheet guide 6*a* is located. The sheet guide 6*a* is configured to rotatably support a roll-shaped label continuous body P while coming in contact with both end faces of the roll-shaped label continuous body P in the width direction (the transverse direction of the label continuous body P), so as to guide the feeding of the label continuous body P. The sheet guide 6*a* is movably located along the transverse direction of the label continuous body P so as to change its position in accordance with the width of the label continuous body P (the length of the transverse direction of the label continuous body P).

As shown in FIG. 2, the label continuous body P has a long strip of mount PM and a plurality of labels PL temporarily adhering to the mount along the longitudinal direction with predetermined intervals, for example. The label continuous body P is wound into a roll and is contained in the paper container 6. The label attaching face of the mount PM is coated with a parting agent such as silicone so as to facilitate the separation of the labels PL. On the rear face of the label attaching face of the mount PM, location detection marks (not illustrated) indicating the locations of the labels PL are formed with predetermined intervals along the longitudinal direction. On the surface (print surface) of each label PL, a thermosensitive color developing layer is formed that develops a specific color (e.g., black or red) when the temperature reaches a predetermined region.

As shown in FIGS. 1A to 2, a battery cover 7 is pivotally supported openably and closably on one lateral face of the body case 2. This battery cover 7 is an opening and closing cover of a battery container described later (not illustrated in FIGS. 1A to 3).

The opening and closing cover 3 is an opening and closing cover of the paper container 6. In order that one end in the longitudinal direction (at a part closer to the center of the body case 2 in the longitudinal direction) of the opening and closing cover 3 can move away and closer to the body case 2, the other end in the longitudinal direction of the opening and closing cover 3 is pivotally supported at one end part in the longitudinal direction of the body case 2 via a hinge or the like. The opening and closing cover 3 is biased to the opening direction (the direction in which the one end in the longitudinal direction of the opening and closing cover 3 moves away from the body case 2) with a torsional spring (not illustrated in FIGS. 1A to 3) located close to the other end in the longitudinal direction of the opening and closing cover 3.

As shown in FIGS. 2 and 3, a pair of pressing parts 3*a* is located at the forward end of the opening and closing cover 3. This pair of pressing parts 3*a* is to press the separation unit 4 so as to fix the separation unit 4 at the separation ejection position when the opening and closing cover 3 is closed during the separation ejection. The pair of pressing parts 3*a* is located on both ends in the width direction (the direction orthogonal to the longitudinal direction of the opening and closing cover 3) of the opening and closing cover 3.

As shown in FIGS. 2 and 3, a platen roller (one example of a feed roller) 10 is pivotally supported at the forward end of the opening and closing cover 3 so that the roller can rotate in the forward direction and the reverse direction. This platen roller 10 is feed means configured to feed a label continuous body P. This platen roller 10 extends in the width direction of the label continuous body P. This platen roller 10 has a platen shaft 10*a*, and a gear 10*b* is connected to one end of the platen shaft 10*a*. This gear 10*b* engages with a gear (not illustrated) or the like located in the opening 2*a* when the opening and closing cover 3 is closed. The gear 10*b* is mechanically connected to a stepping motor (not illustrated) or the like for roller driving via such a gear located in the opening 2*a*.

As shown in FIGS. 2 and 3, a separation pin 11 is located along the platen roller 10 at the one end in the longitudinal direction of the opening and closing cover 3 and in the vicinity of the platen roller 10. This separation pin 11 is configured to separate the labels PL from the mount PM. Both ends in the longitudinal direction of the separation pin 11 are pivotally supported at the opening and closing cover 3.

As shown in FIGS. 2 and 3, sensors 12 (12*a*, 12*b*) are located on a face of the opening and closing cover 3 at the one end in the longitudinal direction thereof. The face is adjacent to a sheet-feeding route when the opening and closing cover 3 is closed. The sensor 12*a* is configured to detect the position of the labels PL (the location detection marks of the mount PM as described above). This sensor 12*a* is a reflective optical sensor, for example. The sensor 12*b* is configured to detect the presence or absence of the labels PL (e.g., a part of the mount PM between neighboring labels PL). The sensor 12*b* is a transmissive optical sensor, for example.

The separation unit 4 has a function to separate the labels PL from the mount PM during the separation ejection and to cause the feeding paths of the mount PM and the labels PL to branch. The one end in the longitudinal direction of the separation unit 4 can move between the continuous ejection position inside of the printer 1 and the separation ejection position outside of the printer 1. The configuration of the separation unit 4 is described later.

As shown in FIGS. 1A to 2, the front cover 5 is fixed to the body case 2 so as to cover a part of the opening 2*a* of the body case 2 on the opposite side of the opening and closing cover 3 and parts near both of the lateral faces of the body case 2. A display unit 15, operation buttons 16*a*, 16*b*, a power-supply button 17, a cover-open button 18, a pair of release levers 19 and a cutter 20 are located on the front cover 5.

The display unit 15 is a screen to display an operation command, a message or the like. The display unit 15 is an LCD (Liquid Crystal Display), for example. The operation buttons 16*a*, 16*b* are configured to manipulate the operation of the printer 1. The power-supply button 17 is configured to turn the power supply of the printer 1 on or off.

The cover-open button 18 is configured to open the opening and closing cover 3. The release levers 19 are configured to hold the separation unit 4 at the continuous ejection position. The held separation unit 4 can be released by moving these release levers 9 closer to each other.

The cutter 20 is configured to cut the mount PM of the label continuous body P that is continuously ejected. The cutter 20 is located at a forward end part of the front cover 5 on the opposite side of the opening and closing cover 3. The cutter 20 extends along the width direction of the label continuous body P. The outlet is formed between the opening and closing cover 3 and the front cover 5.

Figure 4:
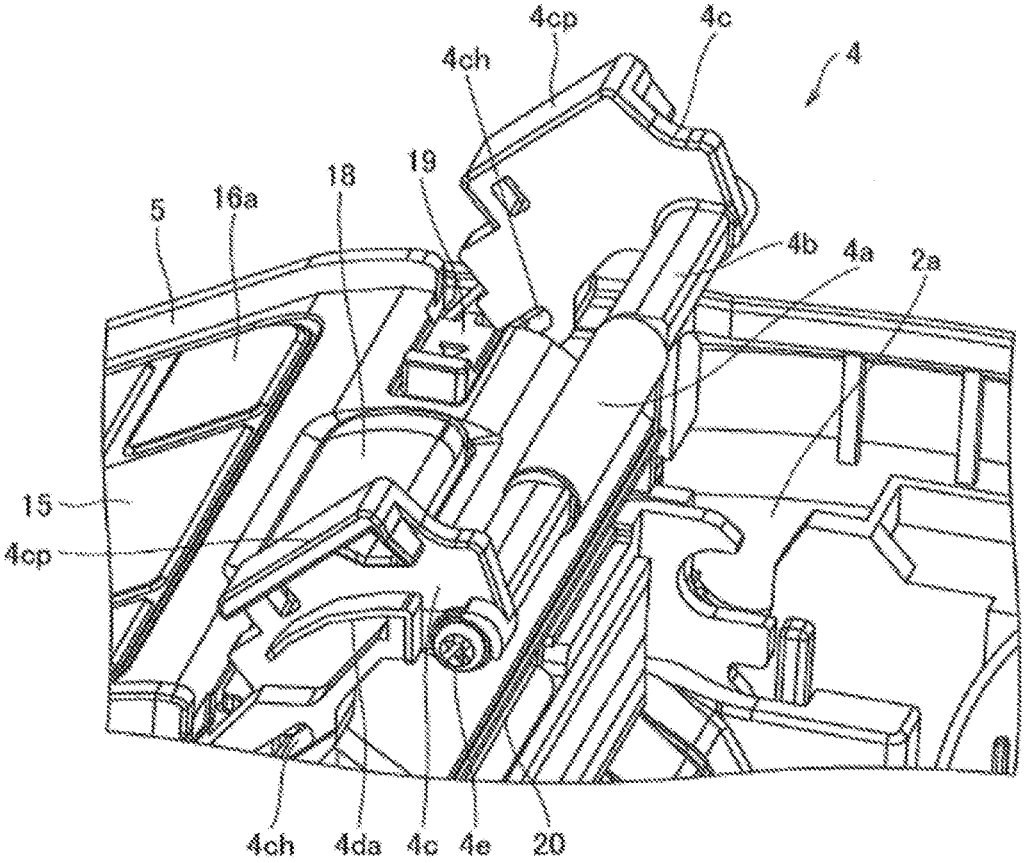
FIG. 4 is an enlarged perspective view of the separation unit of the printer in FIG. 2 and their surrounding major parts.
Figure 5:
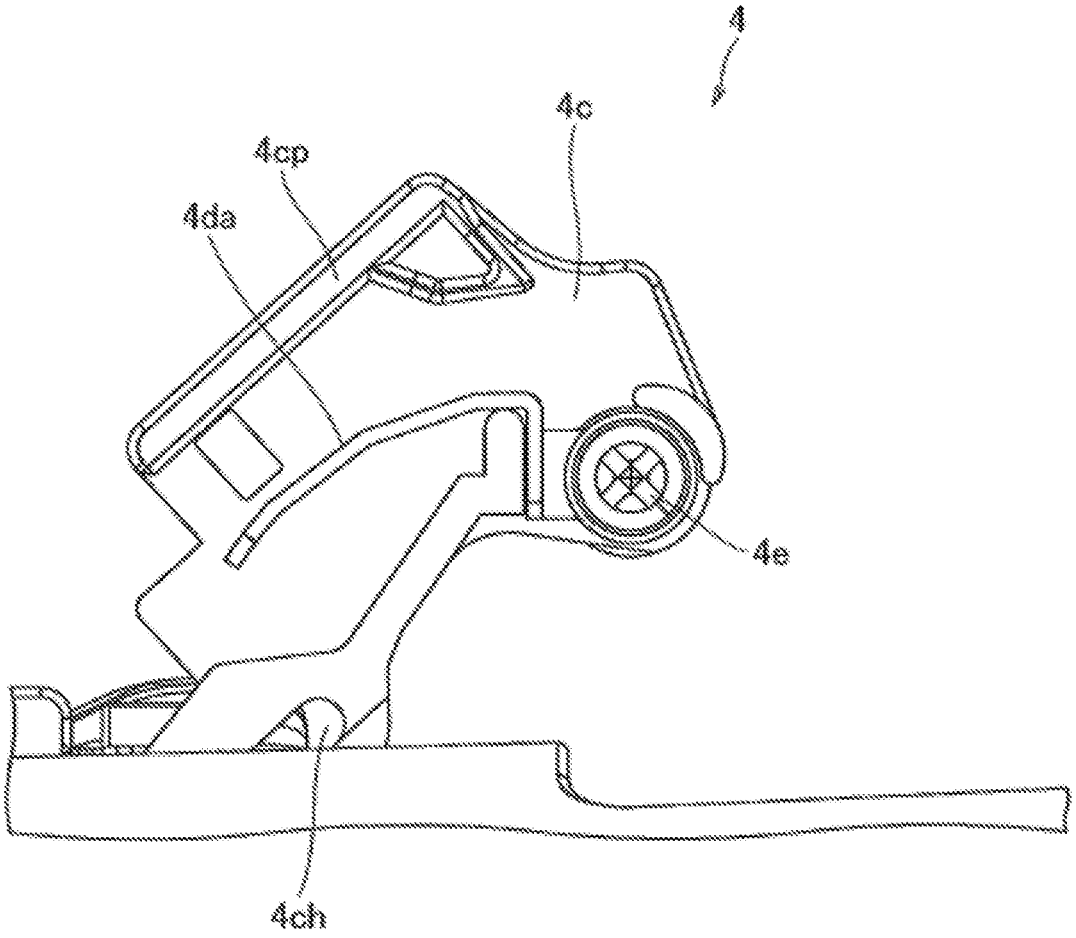
FIG. 5 is a lateral view showing the major part of the separation unit in FIG. 4.
Figure 6A:
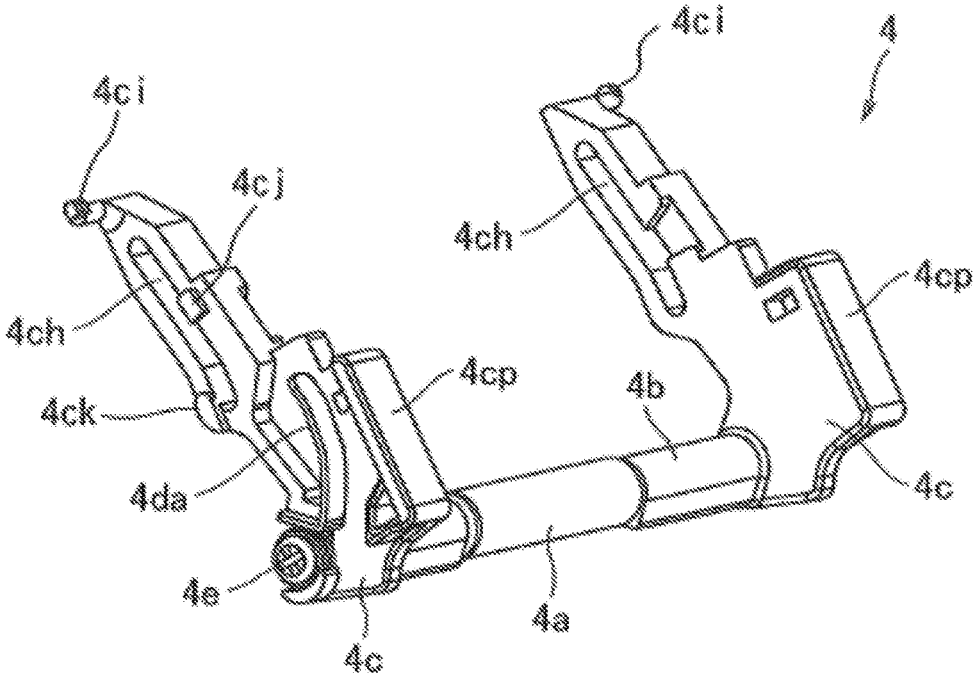
FIG. 6A is an overall perspective view showing the separation unit in FIG. 4 that is extracted.
Figure 6B:
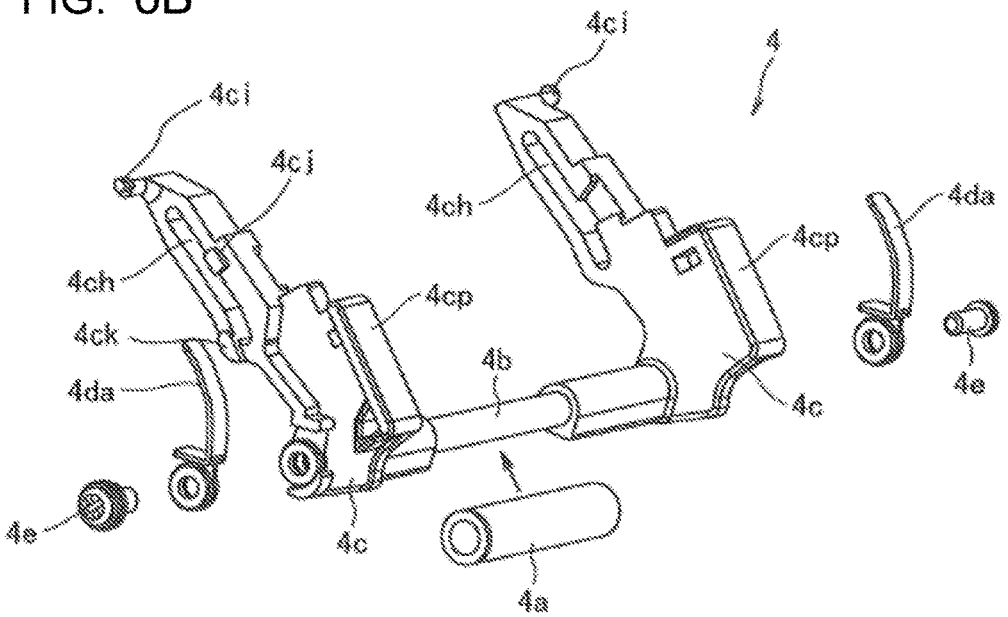
FIG. 6B is an exploded perspective view of the separation unit in FIG. 6A.

The following describes the separation unit 4 with reference to FIGS. 4 to 6B. FIG. 4 is an enlarged perspective view of the separation unit of the printer in FIG. 2 and their surrounding major parts. FIG. 5 is a lateral view showing the major part of the separation unit in FIG. 4. FIG. 6A is an overall perspective view showing the separation unit in FIG. 4 that is extracted. FIG. 6B is an exploded perspective view of the separation unit in FIG. 6A.

The separation unit 4 includes a separation roller 4*a*, a shaft 4*b*, a pair of supporters 4*c*, a pair of plate springs 4*da* and a screw 4*e*.

The separation roller 4*a* is rotatably located at the separation unit on the forward end side that is on one end side adjacent to the opening and closing cover 3. The separation roller 4*a* is located so as to be adjacent to the platen roller 10 during the separation ejection. Therefore, the mount PM inserted between this separation roller 4*a* and the platen roller 10 is fed while being pinched between the separation roller 4*a* and the platen roller 10.

This separation roller 4*a* is made of an elastic member such as rubber. The separation roller 4*a* is pivotally supported at the shaft 4*b* that is sandwiched between one ends in the longitudinal direction of the pair of supporters 4*c*, so as to rotate. The separation roller 4*a* has a length that is shorter than the overall length of the shaft 4*b*. That is, the separation roller 4*a* is partly located at the center in the axial direction of the shaft 4*b*. The separation roller 4*a* is pressed toward the platen roller 10 via the label continuous body P during the separation ejection, so as to rotate following the rotation of the platen roller 10.

The pair of supporters 4*c* is configured to support the separation roller 4*a* and the shaft 4*b*. An eave 4*cp* is formed at an upper part on one end side in the longitudinal direction of each supporter 4*c*. The eave 4*cp* extends outwardly from a lateral face of each supporter 4*c*. As shown in FIGS. 6A and 6B, a guide rail hole (one example of a long hole) 4*ch* is formed on the other end side in the longitudinal direction of the supporter 4*c*. This guide rail hole 4*ch* is configured to guide and regulate the movement of the separation unit 4. The guide rail hole 4*ch* is a long hole along the longitudinal direction of the supporter 4*c*. The separation unit 4 is attached to a support board 41 (the details thereof are described later) by inserting a shaft (one example of a swing shaft) 42 mounted to the support board 41 into the guide rail holes 4*ch*. Although a pair of the shafts 42 is associated with the pair of supporters 4*c* in the present embodiment, the shafts 42 and the supporters 4*c* may be integrated. The swing shaft may not be the shafts 42, but may be a protrusion or the like, that acts as an axis.

The pair of plate springs 4*da* is an elastic structure that comes into contact with the pressing parts 3*a* of the opening and closing cover 3 so as to bias the separation roller 4*a* toward the platen roller 10 when the opening and closing cover 3 is closed while the separation unit 4 moves to the separation ejection position. In an outer lateral face of each supporter 4*c*, each plate spring 4*da* is fixed at the one end side in the longitudinal direction of the supporter 4*c* (the side on which the separation roller 4*a* is located), and extends from the one end side in the longitudinal direction of the supporter 4*c* like a curve toward the other end side (the side on which the guide rail hole 4*ch* is located) in the longitudinal direction. The terminal end of each plate spring 4*da* floats.

Figure 7:
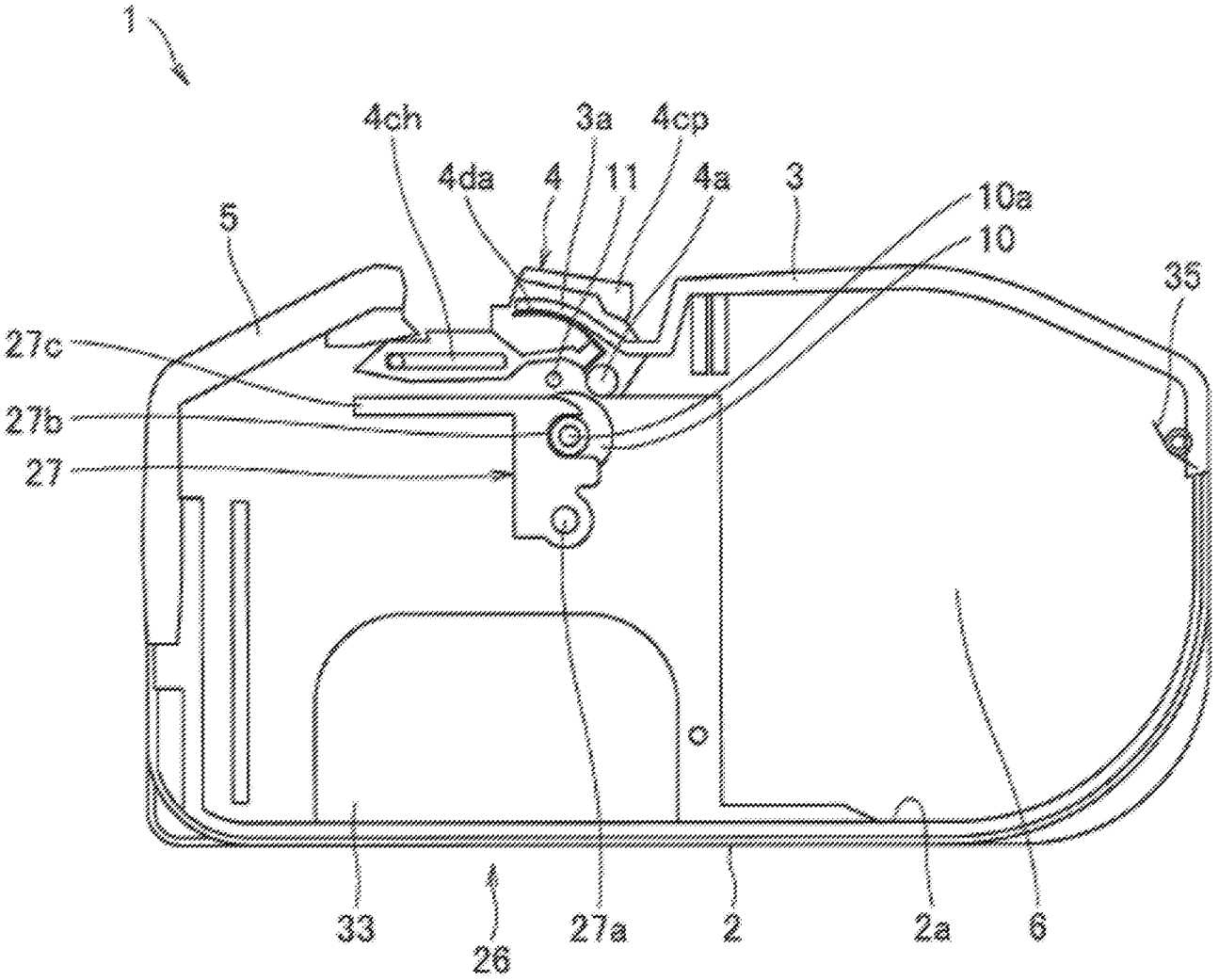
FIG. 7 schematically shows the configuration that is a view of the inside of the printer in the separation ejection state of FIGS. 1A and 1B from the lateral face.
Figure 8A:
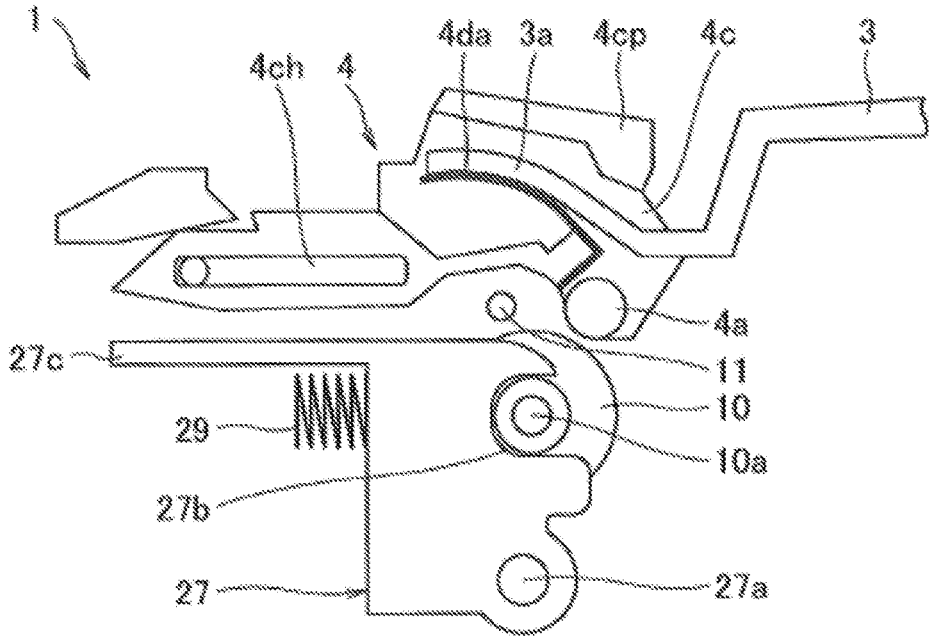
FIG. 8A is an enlarged schematic view of the major part of the printer of FIG. 7.
Figure 8B:
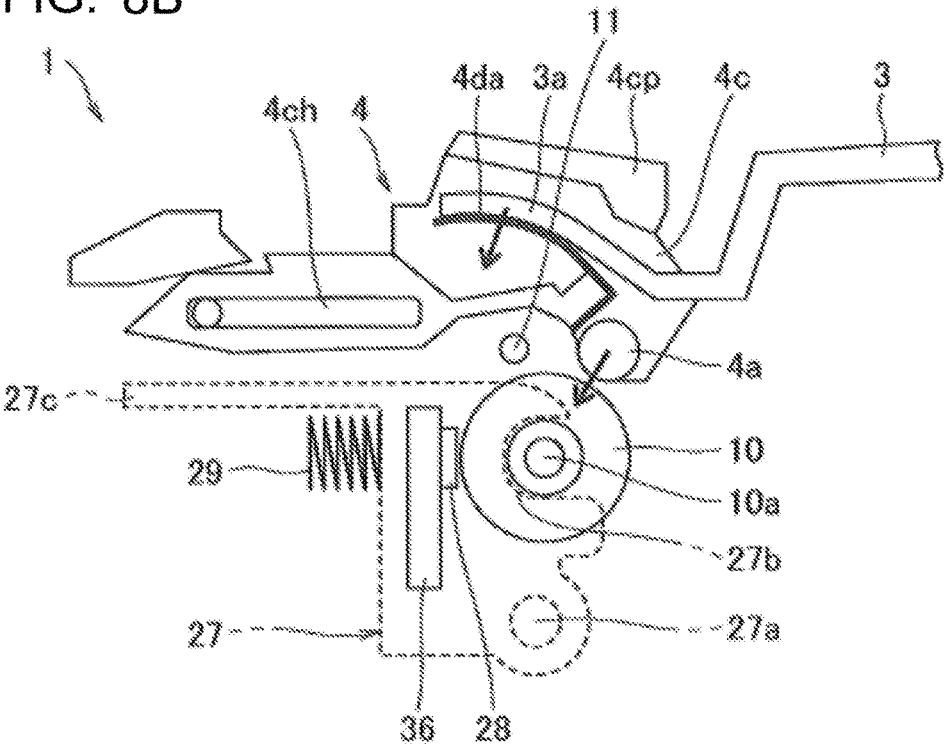
FIG. 8B is an enlarged schematic view of the major part of the printer of FIG. 7.

The internal configuration of the printer 1 is described with reference to FIGS. 7 to 8B. FIG. 7 schematically shows the configuration that is a view of the inside of the printer in the separation ejection state of FIGS. 1A and 1B from the lateral face. FIGS. 8A and 8B are enlarged schematic views of the major part of the printer of FIG. 7.

As shown in FIG. 7, a print body 26 is located adjacent to the paper container 6 in the opening 2*a* of the body case 2. The print body 26 is configured to print on the labels PL of the label continuous body P. The print body 26 includes a head bracket 27, a thermal head (one example of a print head) 28 (see FIG. 8B), a coil spring 29 (see FIGS. 8A and 8B), the separation unit 4 and a battery container 33 (see FIG. 7).

The head bracket 27 is configured to hold the opening and closing cover 3 that is closed. This head bracket 27 is located in the body case 2 so as to swing about a rotating shaft 27*a* on the opposite side of the platen roller 10 when the opening and closing cover 3 is closed.

This head bracket 27 has a groove 27*b*. In this groove 27*b*, the platen shaft 10*a* of the platen roller 10 is fitted so that the head bracket 27 holds the opening and closing cover 3.

The head bracket 27 has a pressurization part 27*c*. This pressurization part 27*c* is located at a position (immediately below) adjacent to the cover-open button 18 shown in FIGS. 1A and 1B. When the cover-open button 18 is pressed, the pressurization part 27*c* also is pressed, so as to release the holding of the opening and closing cover 3 by the head bracket 27. Then, when the holding of the opening and closing cover 3 is released, the opening and closing cover 3 will open automatically by the biasing force of the torsional spring 35 (see FIG. 7) located on the other end side in the longitudinal direction of the opening and closing cover 3.

The thermal head 28 (see FIG. 8B) is print means to print information such as letters, symbols, graphics, barcodes, or the like on the labels PL. The thermal head 28 is mounted at the head bracket 27 via a circuit board 36. The thermal head 28 is adjacent to the platen roller 10 when the opening and closing cover 3 is closed. The print face of the thermal head 28 faces the sheet-feeding route. On the print face of the thermal head 28, a plurality of heater resistors (heater elements) that generate heat when applying current are arranged along the width direction of the label continuous body P (the transverse direction of the mount PM). The circuit board 36 is a wiring board configured to transmit print signals to the thermal head 28.

The coil spring 29 (see FIGS. 8A and 8B) is configured to bias the head bracket 27 and the thermal head 28 toward the platen roller 10 when the opening and closing cover 3 is closed. The coil spring 29 is located on the rear side of the head bracket 27 (the rear face of the mounting face of the circuit board 36). Biasing force of this coil spring 29 presses the head bracket 27 toward the platen roller 10. Thus, the platen shaft 10*a* fitted into the groove 27*b* of the head bracket 27 also can be pressed firmly. Thereby the holding of the opening and closing cover 3 by the head bracket 27 can be kept.

As shown in FIG. 8B, the pressing part 3*a* of the opening and closing cover 3 is located at a gap between the eave 4*cp* and the plate springs 4*da* of the separation unit 4 during the separation ejection. The pressing part 3*a* comes in contact with and presses the plate spring 4*da* so as to press the separation unit 4. Thus, the separation unit 4 is fixed at the separation ejection position, and the separation roller 4*a* of the separation unit 4 is biased toward the platen roller 10. Therefore, the separation roller 4*a* of the separation unit 4 can be biased stably toward the platen roller 10 during the separation ejection.

Figure 9A:
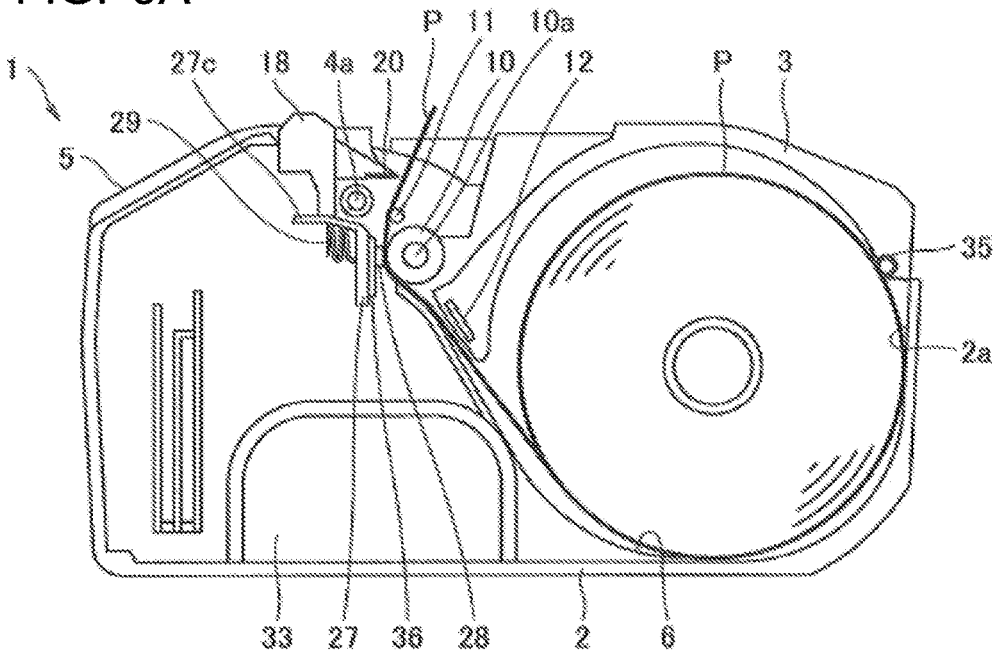
FIG. 9A schematically shows the configuration of the printer of FIG. 1A during continuous ejection.
Figure 9B:
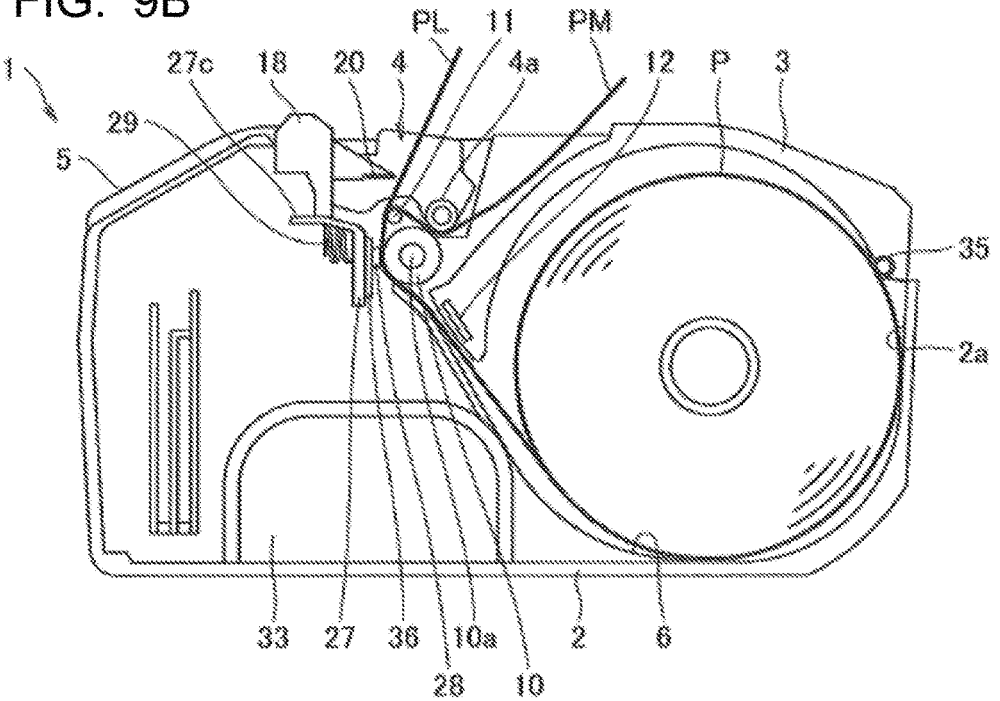
FIG. 9B schematically shows the configuration of the printer of FIG. 1B during separation ejection.

The continuous ejection and the separation ejection by the printer 1 are described with reference to FIGS. 9A and 9B. FIG. 9A schematically shows the configuration of the printer of FIG. 1A during continuous ejection. FIG. 9B schematically shows the configuration of the printer of FIG. 1B during separation ejection.

In both of the continuous ejection mode and the separation ejection mode, at the printing step, while the label continuous body P reeled off from the paper container 6 is pinched between the thermal head 28 and the platen roller 10, the platen roller 10 is rotated to feed the label continuous body P. During this feeding, print timing is determined based on the information detected by the sensors 12. Then heat is selectively generated at the heater resistors of the thermal head 28 in accordance with the print signals transmitted to the thermal head 28 at the determined print timing, whereby desired information is printed on the labels PL of the label continuous body P.

During the continuous ejection mode, as shown in FIG. 9A, the separation unit 4 is positionable in the continuous ejection position inside of the printer 1. The printed labels PL are then ejected without being separated from the mount PM. In the case of the continuous ejection mode, the mount with a required number of labels attached thereon is cut off from the label continuous body with the cutter 20. Then, the operator brings this cut-off mount to the site and separates the labels PL from the mount PM for attachment at the site. Therefore, the continuous ejection mode is suitable for the case where a target for attachment of the labels PL is away from the printer 1.

As shown in FIG. 9A, the separation roller 4*a* at the continuous ejection position is stored inside of the body case 2. Thus, the separation roller 4*a* does not stick out from the body case 2. The separation roller 4*a* is easily kept from the hands of the operator, and therefore deterioration of the separation roller 4*a* can be prevented.

Meanwhile, during the separation ejection mode, as shown in FIG. 9B, the separation unit 4 is positionable in the separation ejection position, and a mount PM is pinched between the separation roller 4*a* of the separation unit 4 and the platen roller 10 via the separation pin 11. Thereby, when the platen roller 10 is rotated to feed the label continuous body P for printing, the mount PM is fed while being pinched between the separation roller 4*a* and the platen roller 10. During the feeding, the printed labels PL are separated from the mount PM one by one, and are ejected from the printer. In the case of the separation ejection mode, the labels PL are ejected one by one. Therefore, the separation ejection mode is suitable for the case where a target for attachment of the labels PL is located near the printer 1.

The printer 1 of the present embodiment can be switched between the continuous ejection mode and the separation ejection mode. Therefore, this printer 1 can support two situations including the situation in which the target for attachment of labels PL is located close to the printer 1, and the other situation in which such target is away from the printer 1. This makes the printer 1 useful and economical.

Figure 10:
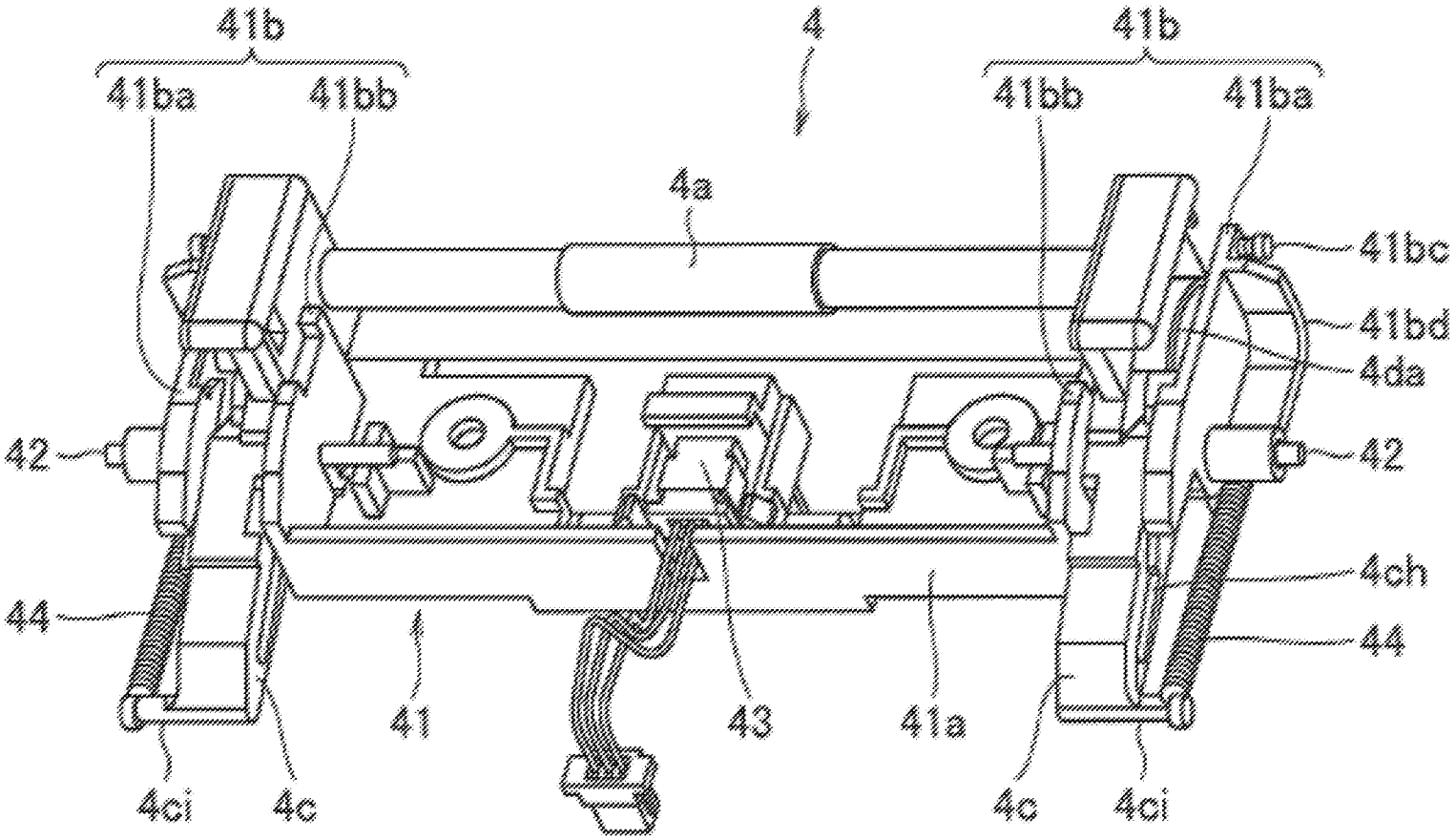
FIG. 10 is a perspective view showing the separation unit and the support board at the continuous ejection position.
Figure 11:
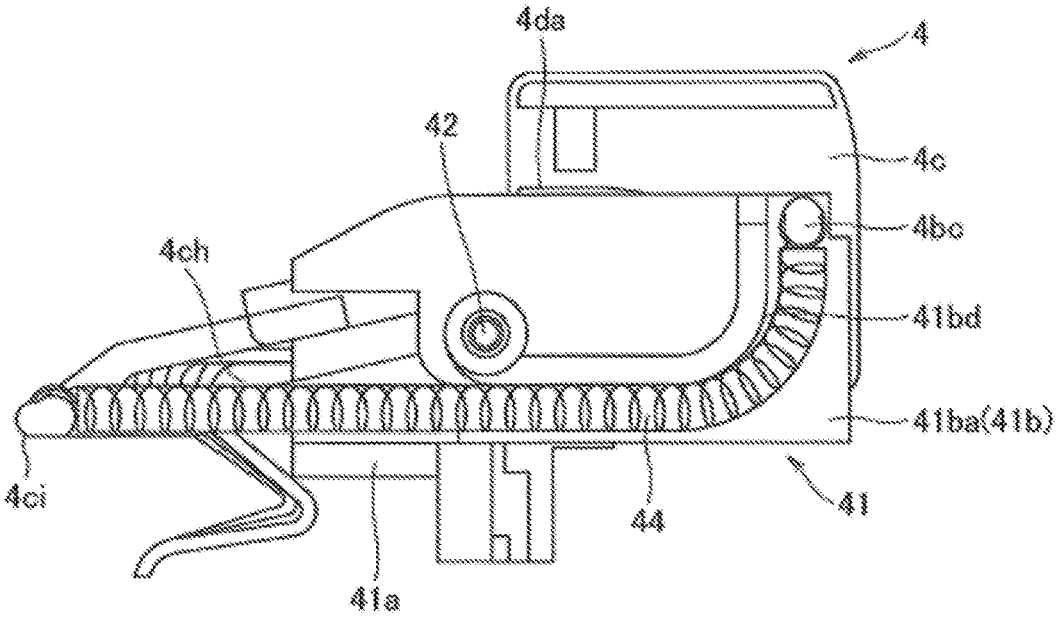
FIG. 11 is a lateral view of the separation unit and the support board of FIG. 10.
Figure 12:
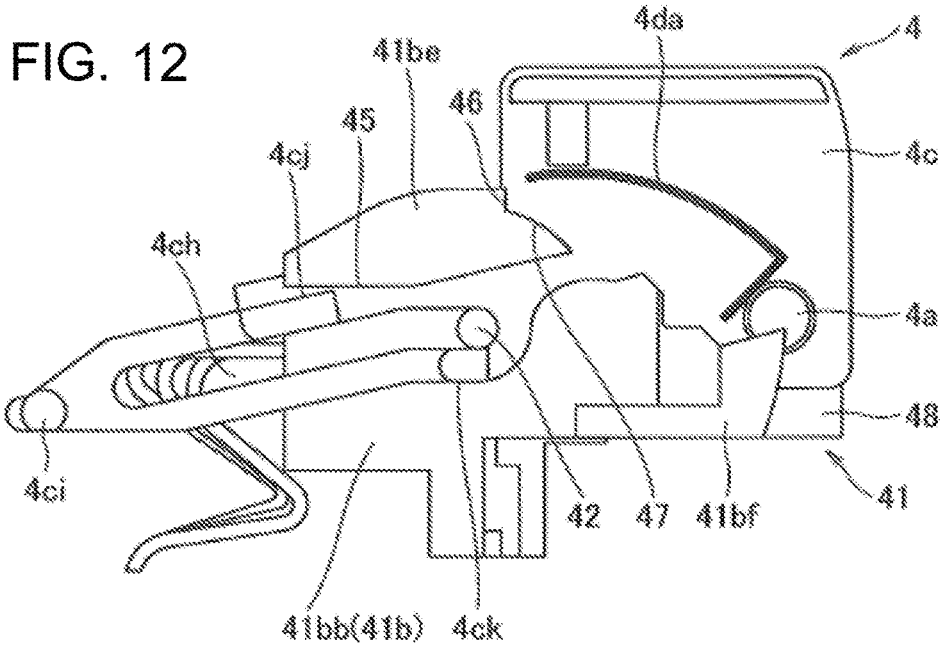
FIG. 12 describes the relationship between the components formed on the face of a first attachment piece adjacent to second attachment piece at the support board of FIG. 10 and the separation unit.

Referring to FIGS. 10 to 12, the support board 41 to which the separation unit 4 is mount is described below. FIG. 10 is a perspective view showing the separation unit and the support board in the continuous ejection position. FIG. 11 is a lateral view of the separation unit and the support board of FIG. 10. FIG. 12 describes the relationship between the components located on the face of a first attachment piece adjacent to a second attachment piece at the support board of FIG. 10 and the separation unit.

The support board 41 is located in the opening 2*a* of the body case 2. This support board 41 has a base 41*a*. At this base 41*a*, a separation sensor 43 is located that is a light-reflective sensor configured to detect the presence or absence of the labels PL during the separation ejection. At both ends in the width direction of the base 41*a*, a pair of unit attachment parts 41*b* configured to attach the separation unit 4 is located.

Each of the unit attachment parts 41*b* has a first attachment piece 41*ba* located outside in the width direction of the base 41*a* and a second attachment piece 41*bb* located inside in the width direction of the base 41*a*. This second attachment piece 41*bb* is adjacent to the first attachment piece 41*ba*. The small gap is formed between the first attachment piece 41*ba* and the second attachment piece 41*bb*. The supporter 4*c* of the separation unit 4 is located at the small gap and sandwiched between the first attachment piece 41*ba* and the second attachment piece 41*bb*.

At each of the unit attachment parts 41*b*, a shaft 42 is mounted so as to extend between the first attachment piece 41*ba* and the second attachment piece 41*bb*. This shaft 42 is inserted into the guide rail hole 4*ch* that is formed at the supporter 4*c*. The supporter 4*c* is sandwiched between the first attachment piece 41*ba* and the second attachment piece 41*bb*. That is, the guide rail hole 4*ch* engages with the shaft 42.

Therefore, as the guide rail hole 4*ch* moves along the shaft 42, the separation unit 4 can slide along the shaft 42 and can swing about the shaft 42.

As shown in FIGS. 10 and 11, a coil spring 44 is mounted between the separation unit 4 and the support board 41. One end of the coil spring 44 is fixed to an attachment protrusion 41*bc* that is located at one end part of the first attachment piece 41*ba* of the unit attachment part 41*b*. The coil spring 44 extends from the one end part of the first attachment piece 41*ba* while bending along a guide eave 41*bd* that bents like a substantially L-letter shape on a lateral face of the first attachment piece 41*ba*. The other end of the coil spring 44 is attached to an attachment protrusion 4*ci* that is located on the other end side in the longitudinal direction of the supporter 4*c* (on the opposite side in the longitudinal direction of the position at which the separation roller 4*a* is attached). The shaft 42 that is one example of the swing shaft as described above is located on the side in which a line segment connecting the both ends of the coil spring 44 can be drawn relative to the bending coil spring 44. Such a bending coil spring 44 along the guide eave 41*bd* causes a required tensile force while saving the space.

This configuration applies the separation unit 4 receives a first biasing force and a second biasing force to the separation unit 4. The direction of the first biasing force is a direction in which the guide rail hole 4*ch* on the attachment protrusion 4*ci* side contacts with the shaft 42 (in the opposite direction from the continuous ejection position). The direction (one example of a first rotation direction) of the second biasing force is a direction in which the separation unit 4 swings away from the thermal head 28 about the guide rail hole 4*ch* on the attachment protrusion 4*ci* side as the fulcrum that is in contact with the shaft 42 due to the first biasing force. That is, the coil spring 44 applies the two biasing forces, including the first biasing force for sliding and the second biasing force for swinging in the first rotation direction, to the separation unit 4.

Thereby, when the holding at the continuous ejection position is released by the release levers 19, the biasing force of the coil spring 44 causes the separation unit 4 to move (slide) in the opposite direction from the continuous ejection position. When the one end of the guide rail hole 4*ch* comes in contact with the shaft 42 (slide movement position), the separation unit 4 swings about the shaft 42 as the fulcrum in the first rotation direction to a predetermined swing end (swing end position).

As shown in FIG. 12, the supporter 4*c* of the separation unit 4 has a first claw 4*cj* and a second claw 4*ck*. The first claw 4*cj* is located on one of the sides in the transverse direction of the guide rail hole 4*ch*. The second claw 4*ck* is located on the other side in the transverse direction of the guide rail hole 4*ch*. On a face of the first attachment piece 41*ba* adjacent to the second attachment piece 41*bb*, a first protrusion 41*be* and a second protrusion 41*bf* are located.

The first protrusion 41*be* has a guide surface 45. When the separation unit 4 slides from the continuous ejection position to the opposite side along the shaft 42, the first claw 4*cj* slides along this guide surface 45 so as to guide the movement direction of the separation unit 4. The first protrusion 41*be* has a first stopper 46 as well. This first stopper 46 is configured to come in contact with the first claw 4*cj* when the separation unit 4 swings about the shaft 42 as the fulcrum in the first rotation direction as described above, so as to define the swing end position. The first protrusion 41*be* has a regulation surface 47 as well. When the separation unit 4 swings from the swing end position in a second rotation direction opposite to the first rotation direction to move to the separation ejection position, this regulation surface 47 is configured to regulate the first claw 4*cj* to slide and the separation unit 4 to return to the continuous ejection position.

At the swing end position of the separation unit 4 at which the first claw 4*cj* comes in contact with the first stopper 46, the separation unit 4 on the one end side that is adjacent to the opening and closing cover 3 (one example of the forward end side) is within the swing trajectory of the opening and closing cover 3.

Meanwhile, the second protrusion 41*bf* is located at a second stopper 48. When the separation unit 4 is positionable in the separation ejection position, the second claw 4*ck* comes in contact with the second protrusion 41*bf* so as to regulate the separation unit 4 to return to the continuous ejection position.

Figure 14A:
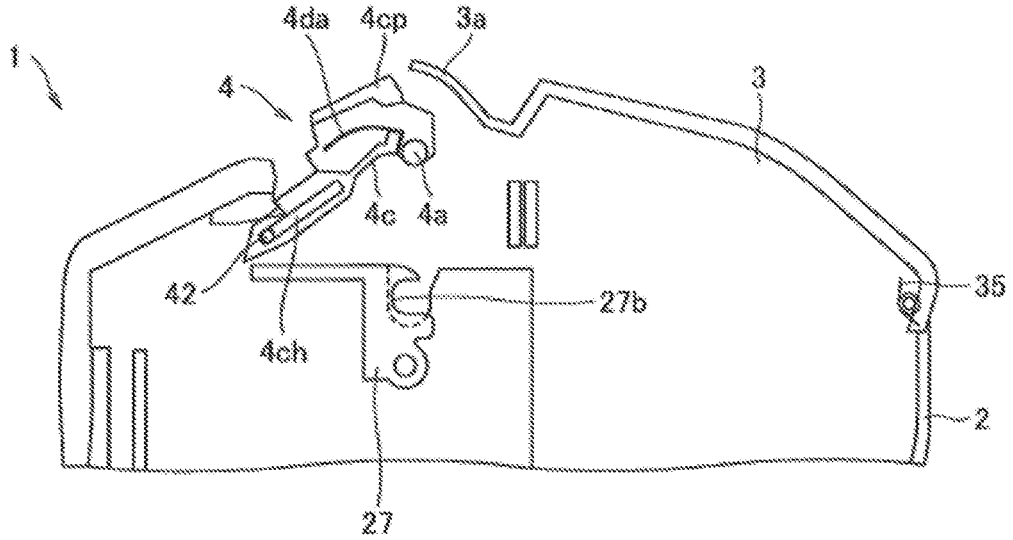
FIG. 14A schematically shows the configuration of the major part of the printer, showing the state following FIG. 13B of the separation unit and the opening and closing cover to set the separation unit at the separation ejection position.
Figure 14B:
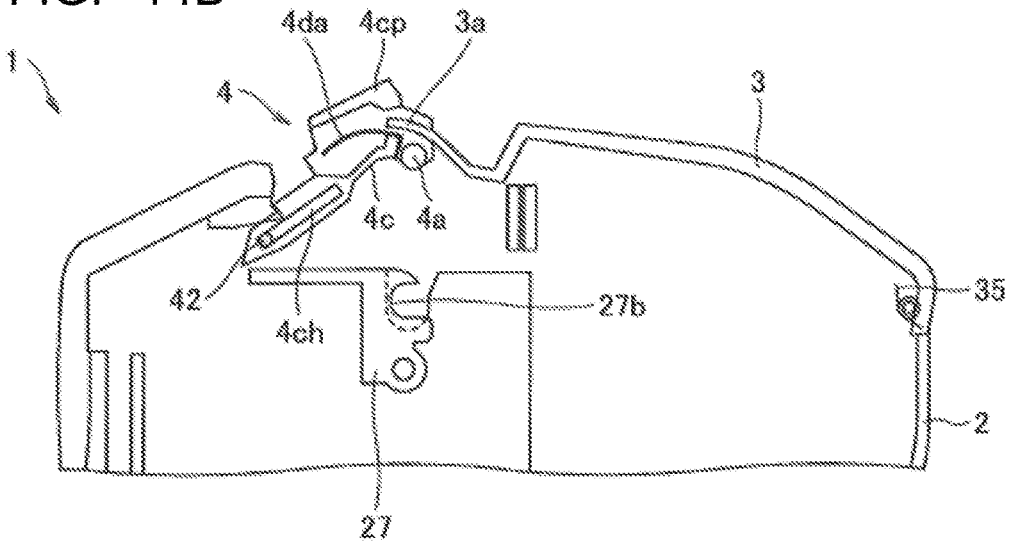
FIG. 14B schematically shows the configuration of the major part of the printer, showing the state following FIG. 13B of the separation unit and the opening and closing cover to set the separation unit at the separation ejection position.
Figure 15A:
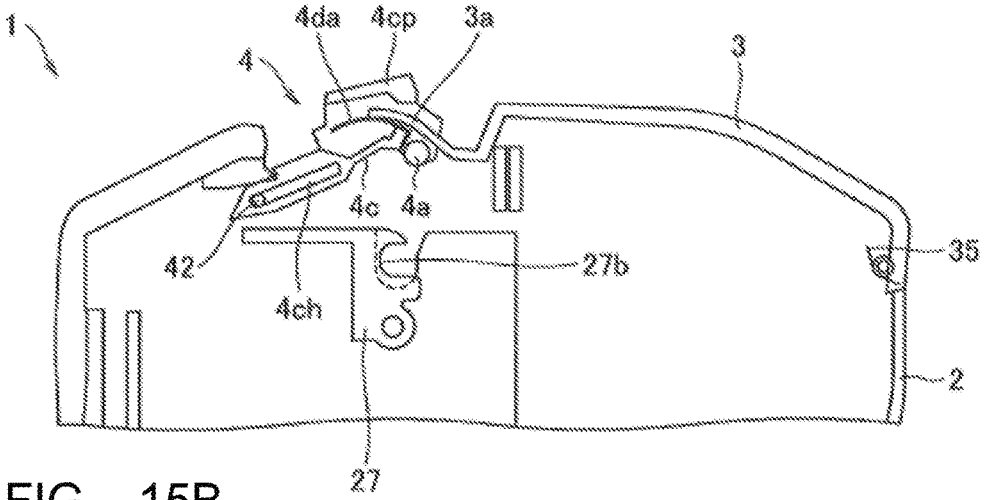
FIG. 15A schematically shows the configuration of the major part of the printer, showing the state following FIG. 14B of the separation unit and the opening and closing cover to set the separation unit at the separation ejection position.
Figure 15B:
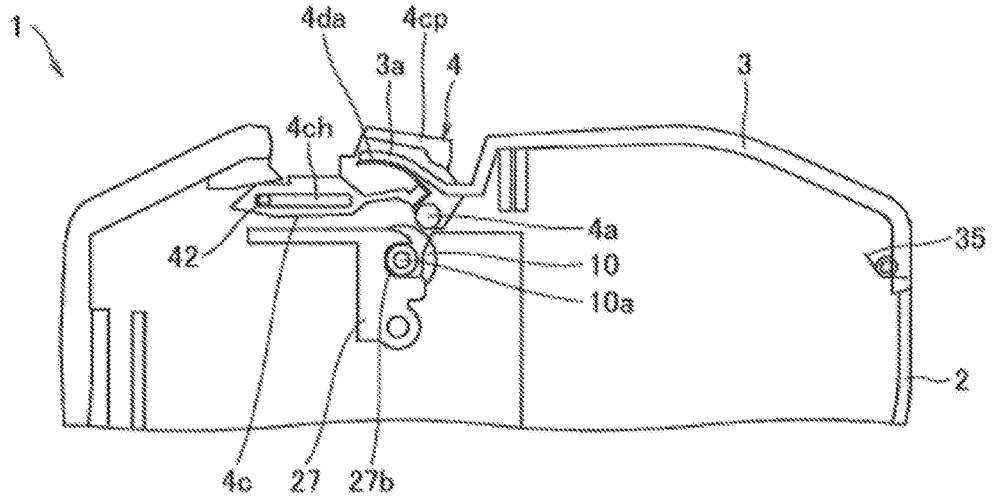
FIG. 15B schematically shows the configuration of the major part of the printer, showing the state following FIG. 14B of the separation unit and the opening and closing cover to set the separation unit at the separation ejection position.
Figure 16:
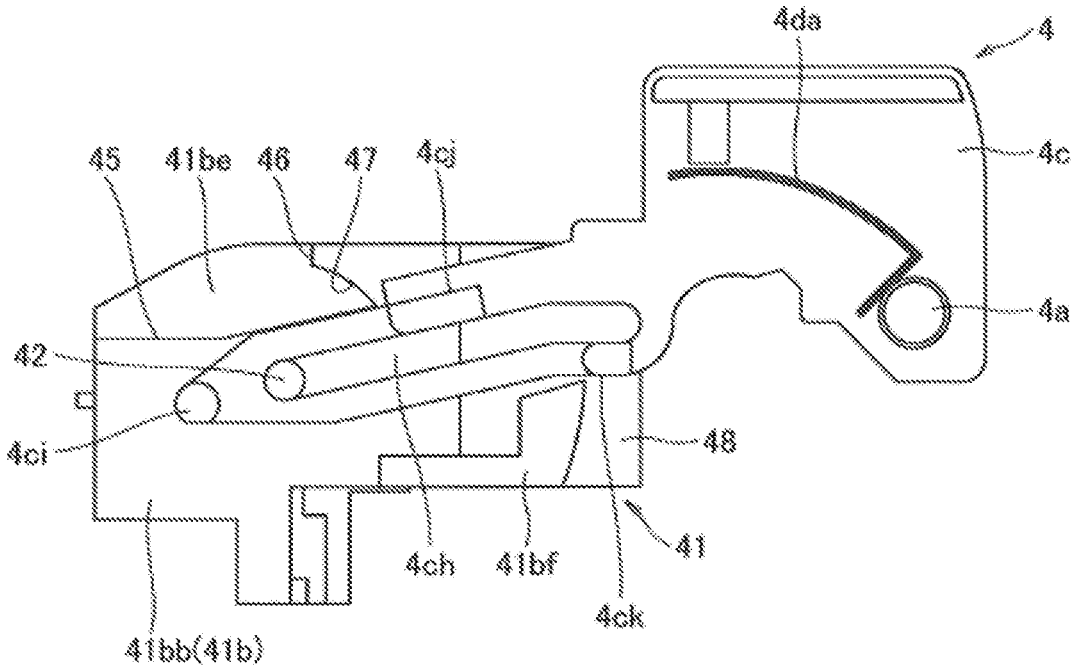
FIG. 16 describes the relationship between the separation unit and the support board of FIG. 13B.
Figure 17:
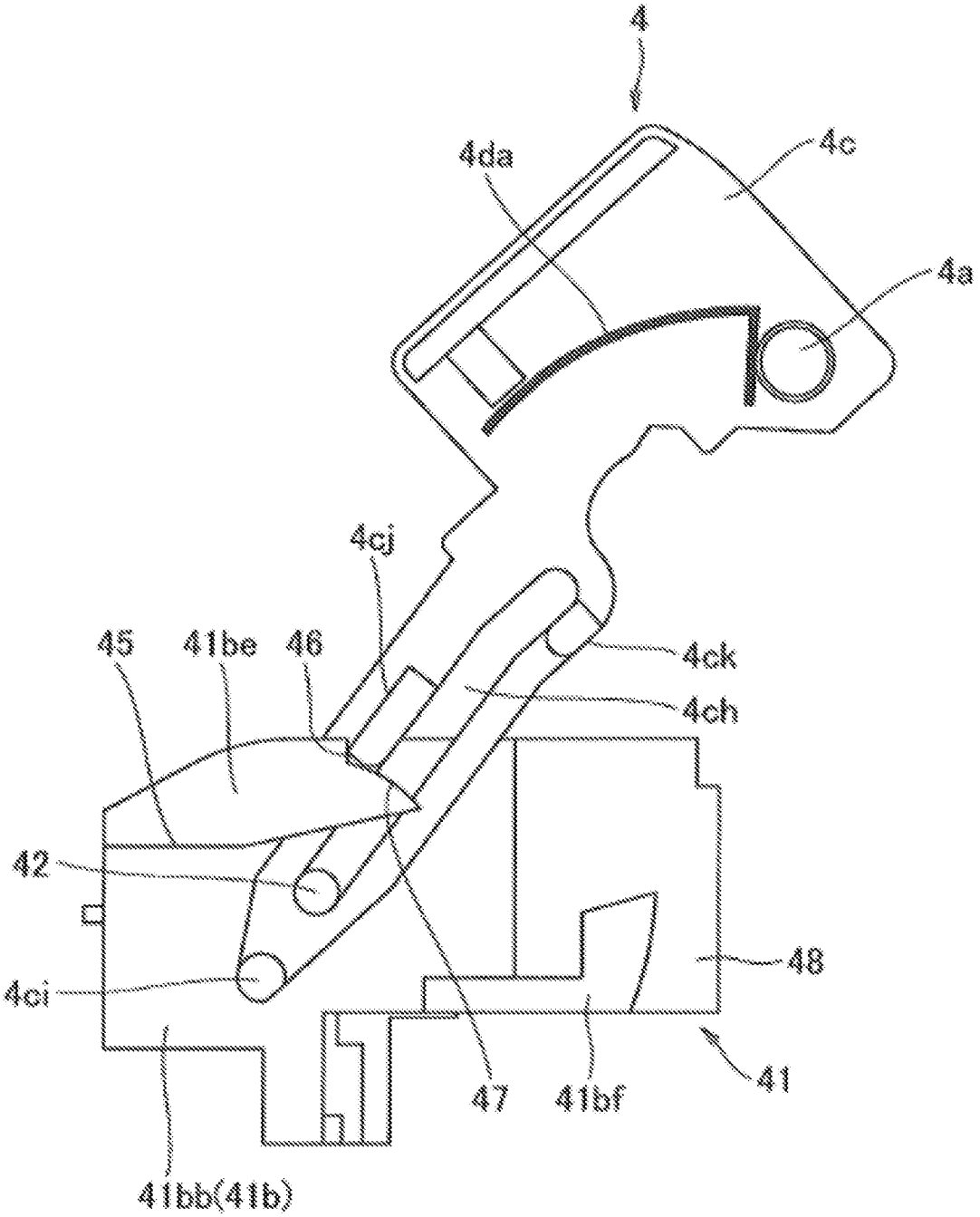
FIG. 17 describes the relationship between the separation unit and the support board of FIG. 14A.
Figure 18:
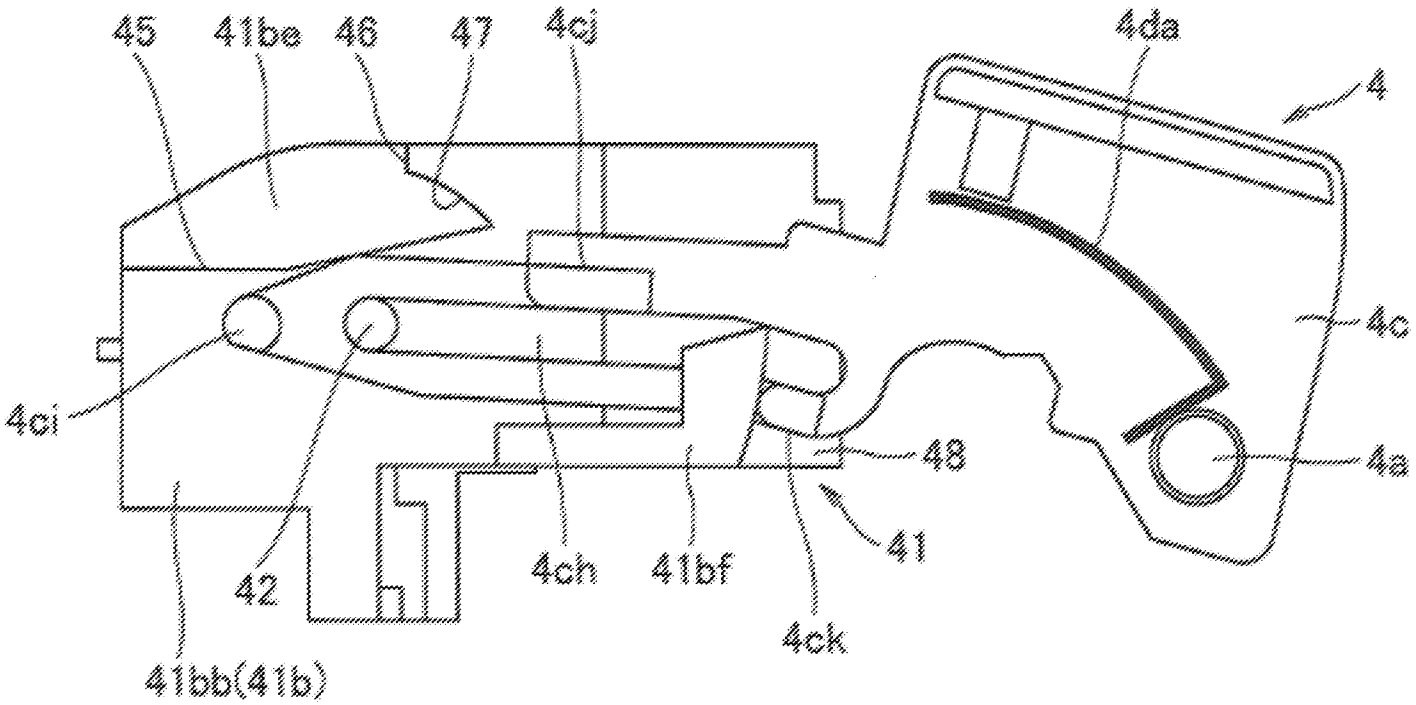
FIG. 18 describes the relationship between the separation unit and the support board of FIG. 15B.

Referring to FIGS. 12 to 18, the following describes how to set the separation unit 4 of the printer 1 of the present embodiment at the continuous ejection position and the separation ejection position. FIGS. 13A to 15B schematically show the configuration of the major part of the printer, showing the separation unit and the opening and closing cover when the separation unit is set at the separation ejection position. FIGS. 16 to 18 describe the relationship between the separation unit and the support board when the separation unit is set at the separation ejection position.

FIG. 14A shows a stage before the setting of the separation unit 4 at the separation ejection position. The separation unit 4 at the stage before setting at the separation ejection position is located to obliquely protrude from the upper face (the face at which the outlet is formed) of the printer 1.

Figure 13A:
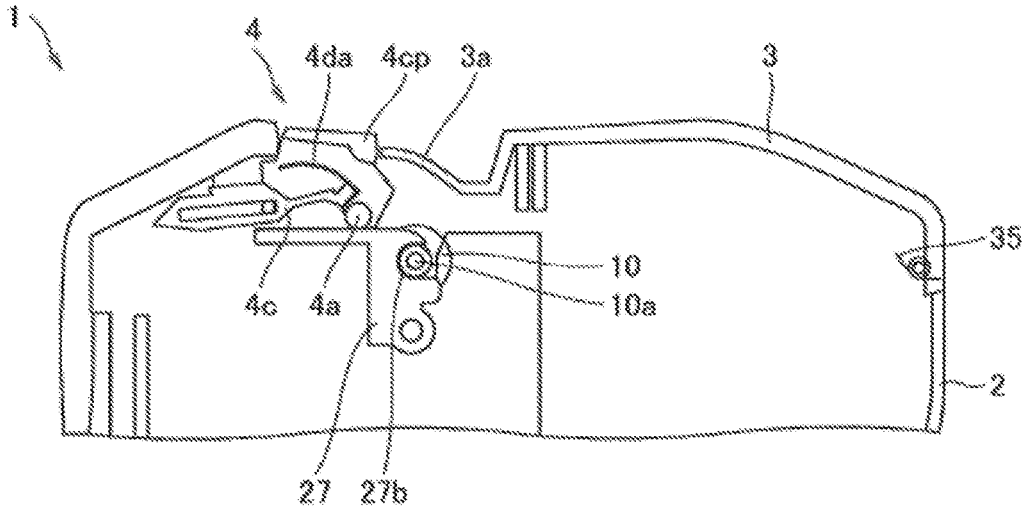
FIG. 13A schematically shows the configuration of the major part of the printer, showing the state of the separation unit and the opening and closing cover when the separation unit is set at the continuous ejection position.

As shown in FIGS. 13A and 12, when the separation unit 4 is set at the continuous ejection position, the one end of the guide rail hole 4*ch* comes in contact with the shaft 42 against the biasing force of the coil spring 44, and the separation roller 4*a* is not adjacent to the platen roller 10.

Figure 13B:
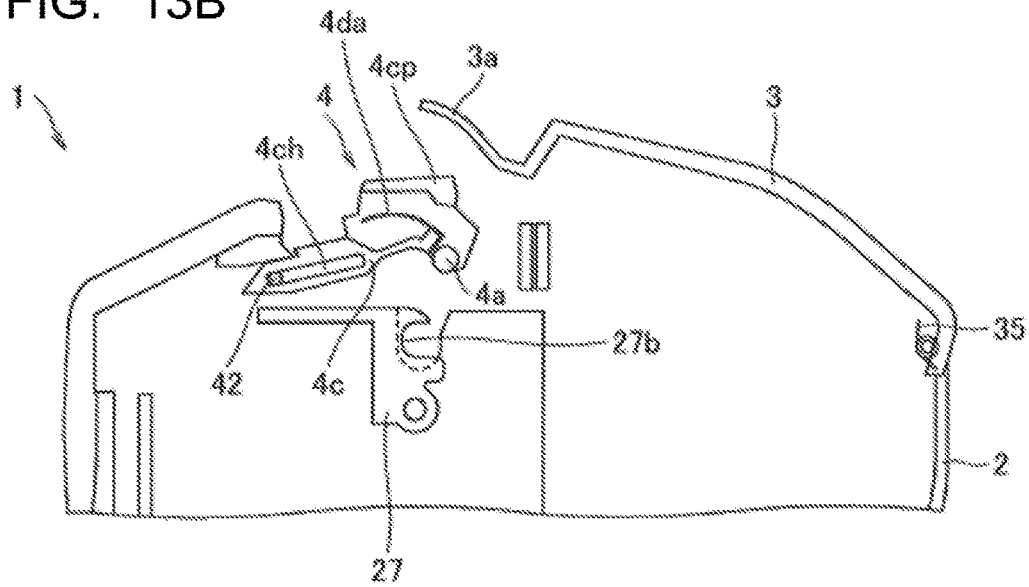
FIG. 13B schematically shows the configuration of the major part of the printer, showing the state of the separation unit and the opening and closing cover to set the separation unit at the separation ejection position.

From this continuous ejection position, the opening and closing cover 3 is moved to the opening position when the cover-open button 18 is pushed. The holding of the separation unit 4 at the continuous ejection position is released when the release levers 19 is manipulated. When the holding of the separation unit 4 is released, as shown in FIGS. 13B and 16, the biasing force of the coil spring 44 causes the separation unit 4 to move (slide) to the side opposite to the continuous ejection position. When the separation unit 4 moves to the side opposite to the continuous ejection position, the one end of the guide rail hole 4*ch* comes in contact with the shaft 42 (at the slide movement position). At this time, the first claw 4*cj* of the supporter 4*c* slides on the guide surface 45 formed on the base 41*a*, whereby the separation unit 4 can move to the slide movement position smoothly.

Subsequently, as shown in FIGS. 14A and 17, the biasing force of the coil spring 44 causes the separation unit 4 that is positionable in the slide movement position to swing in the first rotation direction in the printer 1 placed laterally. This first rotation direction is the direction in which the separation roller 4*a* moves upward about the shaft 42 as the fulcrum (i.e., the separation roller 4*a* moves away from the thermal head 28 about the shaft 42 as the fulcrum). Then, when the first claw 4*cj* comes in contact with the first stopper 46 of the base 41*a*, the separation unit 4 is positionable in the swing end position. At the swing end position, the ejection port configured to eject the label continuous body P is open. Thus, the label continuous body P can be set easily (see FIGS. 9A and 9B).

As described above, when the separation unit 4 is positionable in the swing end position, the separation unit 4 on the forward end side that is the one end side adjacent to the opening and closing cover 3 is within the swing trajectory of the opening and closing cover 3.

As shown in FIG. 14B, as the opening and closing cover 3 is closed, the forward end of the separation unit 4 engages with the forward end of the opening and closing cover 3. The separation unit 4 swings in the second rotation direction against the biasing force of the coil spring 44 about the shaft 42 as the fulcrum so as to follow the movement of the opening and closing cover 3, and starts to move to the separation ejection position. As the opening and closing cover 3 is further closed, as shown in FIG. 15A, the separation unit 4 further swings in the second rotation direction along with the swinging of the opening and closing cover 3 to the closed position. At this time, the first claw 4*cj* of the supporter 4*c* slides on the regulation surface 47 of the base 41*a* so as to regulate the separation unit 4 to return to the continuous ejection position.

When the opening and closing cover 3 is completely closed, as shown in FIGS. 15B and 18, the platen shaft 10*a* of the platen roller 10 pivotally supported at the opening and closing cover 3 is fitted into the groove 27*b* of the head bracket 27, so as to hold the opening and closing cover 3. Further, while the separation roller 4*a* of the separation unit 4 is biased toward the platen roller 10 by the opening and closing cover 3, the separation unit 4 is held at the separation ejection position. At the separation ejection position, the second claw 4*ck* of the supporter 4*c* comes in contact with the second protrusion 41*bf* of the second stopper 48 so as to regulate the separation unit 4 to return to the continuous ejection position.

In order to move the separation unit 4 from the separation ejection position to the continuous ejection position, the opening and closing cover 3 is moved to the open position by pressing the cover-open button 18, so as to release the holding of the separation unit 4 that is held at the separation ejection position by the opening and closing cover 3. Thereby, the biasing force of the coil spring 44 causes the separation unit 4 to swing in the first rotation direction. When the separation unit 4 swings in the first rotation direction, the first claw 4*cj* of the supporter 4*c* comes in contact with the first stopper 46 of the support board 41. Thereby, the separation unit 4 is positionable in the swing end position.

The separation unit 4 is caused to swing in the second rotation direction against the biasing force of the coil spring 44 by pressing the first claw 4*cj* of the separation unit 4 against the regulation surface 47 of the support board 41. When the separation unit 4 reaches at the end of the regulation surface 47, the separation unit 4 moves to the slide movement position (the position where the separation unit slides in the opposite side of the continuous ejection position) as described above. When the separation unit 4 is pressed against the biasing force of the coil spring 44, the separation unit 4 is positionable in the continuous ejection position and is fixed to the continuous ejection position by the release levers 19.

In this way, in the present embodiment, when the holding of the separation unit 4 at the continuous ejection position is released, the separation unit 4 swings in the first rotation direction, so that the one end side of the separation unit that is adjacent to the opening and closing cover 3 is positionable in the swing end position within the swing trajectory of the opening and closing cover 3. Therefore, as the opening and closing cover 3 is closed, the forward end of the separation unit 4 engages with the forward end of the opening and closing cover 3 and swings. When the opening and closing cover 3 is located at the closed position, the separation unit 4 is positionable in the separation ejection position. In this way, the separation unit 4 can be easily switched from the continuous ejection position to the separation ejection position.

The specific description of the invention by the present inventor have been provided by way of the embodiments, however, the embodiments disclosed in the specification are illustrative in all aspects and should not be limited to the disclosed techniques. That is, the technical scope of the present invention should not be construed limitedly based on the descriptions on the above embodiments, but should be construed in accordance with the definitions of the claims. The present invention should cover equivalent and all modifications thereof without departing from the scope of claims.

For instance, in the present embodiment, the guide rail hole 4*ch* that is the long hole comes in contact with the shaft 42 as the swing shaft at the one end or the other end. However, the guide rail hole 4*ch* may not come in contact with the shaft 42 at their ends. That is, it is enough that the shaft 42 as the swing shaft may be located on the one side or on the other side of the guide rail hole 4*ch* as the long hole.

Although the present embodiment describes the case using a label continuous body including a plurality of labels temporarily adhering to a mount as a print medium, the present invention is not limited to this. For instance, a label continuous body (mountless label) having one face as an adhesive face or a continuous sheet without an adhesive face as well as film which can be printed with a thermal head instead of the paper may be used as the print medium. The mountless label, the continuous sheet or the film may have location detection marks thereon. In order to feed a mountless label that exposes adhesive, the feeding path may be coated with non-adhesive and a non-adhesive roller containing silicone may be used.

The invention claimed is:

1. A printer comprising:

a housing;

an opening and closing cover configured to swing with respect to the housing;

a feed roller rotatably located on the opening and closing cover, the feed roller configured to feed a print medium;

a print head located so as to be adjacent to the feed roller at a closed position of the opening and closing cover, the print head configured to print on the print medium; and a separation unit configured to swing with respect to the housing, the separation unit including a separation roller, the separation unit being positionable in a separation ejection position where the separation roller is adjacent to the feed roller, and a continuous ejection position where the separation roller is not adjacent to the feed roller, the separation unit swingable in a first direction from the continuous ejection position to a swing end position, the separation unit swinging in a second direction from the swing end position to the separation ejection position, the separation unit on the forward end side being configured to engage with the opening and closing cover as the opening and closing cover moves to the closed position, the second direction being opposite to the first direction.

2. The printer according to claim 1, wherein the opening and closing cover is rotatably located on the housing.

3. A printer comprising:

a housing;

an opening and closing cover configured to swing with respect to the housing;

a feed roller rotatably located on the opening and closing cover, the feed roller configured to feed a print medium;

a print head located so as to be adjacent to the feed roller at a closed position of the opening and closing cover, the print head configured to print on the print medium; and a separation unit configured to swing with respect to the housing, the separation unit including a separation roller, the separation unit being positionable in a continuous ejection position where the separation roller is stored inside of the housing, a swing end position where the separation unit is within a swing trajectory of the opening and closing cover when the opening and closing cover is located at an opening position, and a separation ejection position where the separation roller is adjacent to the feed roller.

4. The printer according to claim 3, further comprising a holding member configured to hold the separation unit at the continuous ejection position, wherein the separation unit is movable from the continuous ejection position to the swing end position when the separation unit held by the holding member is released.

5. The printer according to claim 4, wherein the opening and closing cover is rotatably located on the housing.

6. The printer according to claim 3, wherein the opening and closing cover is rotatably located on the housing.

7. A printer comprising:

a housing;

an opening and closing cover configured to swing with respect to the housing;

a feed roller rotatably located on the opening and closing cover, the feed roller configured to feed a print medium;

a print head disposed so as to be adjacent to the feed roller at a closed position of the opening and closing cover, the print head configured to print on the print medium; and a separation unit configured to swing with respect to the housing, the separation unit including:

a support board having a long hole and a first stopper, a separation roller that is rotatably located on the separation unit, and a first claw, the separation unit being positionable in a continuous ejection position where the swing shaft is located in a first position in the long hole and the separation roller is not adjacent to the feed roller, a swing end position where the separation unit is within a swing trajectory of the opening and closing cover, and a separation ejection position where the separation roller is adjacent to the feed roller, the separation unit being configured to move from the continuous ejection position while the long hole engages with the swing shaft until the swing shaft is located on a second position in the long hole, and swing in a first direction about the swing shaft to move to the swing end position until the first claw comes in contact with the first stopper, the swing shaft being located in the second position in the long hole at the swing end position, and the separation unit being configured to swing in a second direction to move from the swing end position to the separation ejection position, and engage with the opening and closing cover as the closing of the opening and closing cover moves to the closed position, the second direction being opposite to the first direction.

8. The printer according to claim 7, further comprising an elastic member configured to apply a first biasing force to the separation unit to locate the swing shaft in the second position in the long hole, and to apply a second biasing force to swing the separation unit in the first direction about the swing shaft.

9. The printer according to claim 8, wherein the support board has a guide surface configured to guide the separation unit when the separation unit moves from the continuous ejection position, the first claw sliding on the guide surface when the separation unit moves from the continuous ejection position.

10. The printer according to claim 8, wherein the support board includes a second stopper, and the separation unit has a second claw configured to come in contact with the second stopper so as to regulate the separation unit to return to the continuous ejection position.

11. The printer according to claim 8, wherein the support board has a regulation surface configured to regulate the separation unit to return to the continuous ejection position, the first claw sliding on the regulation surface when the separation unit moves from the swing end position to the separation ejection position.

12. The printer according to claim 8, wherein the opening and closing cover is rotatably located on the housing.

13. The printer according to claim 7, wherein the support board has a guide surface configured to guide the separation unit when the separation unit moves from the continuous ejection position, the first claw sliding on the guide surface when the separation unit moves from the continuous ejection position.

14. The printer according to claim 13, wherein the support board includes a second stopper, and the separation unit has a second claw configured to come in contact with the second stopper so as to regulate the separation unit to return to the continuous ejection position.

15. The printer according to claim 13, wherein the support board has a regulation surface configured to regulate the separation unit to return to the continuous ejection position, the first claw sliding on the regulation surface when the separation unit moves from the swing end position to the separation ejection position.

16. The printer according to claim 13, wherein the opening and closing cover is rotatably located on the housing.

17. The printer according to claim 7, wherein the support board includes a second stopper, and the separation unit has a second claw configured to come in contact with the second stopper to regulate the separation unit to return to the continuous ejection position.

18. The printer according to claim 17, wherein the support board has a regulation surface configured to regulate the separation unit to return to the continuous ejection position, the first claw sliding on the regulation surface when the separation unit moves from the swing end position to the separation ejection position.

19. The printer according to claim 7 wherein the support board has a regulation surface configured to regulate the separation unit to return to the continuous ejection position, the first claw sliding on the regulation surface when the separation unit moves from the swing end position to the separation ejection position.

20. The printer according to claim 7, wherein the opening and closing cover is rotatably located on the housing.

* * * * *